US011198588B2

(12) United States Patent
Morse et al.

(10) Patent No.: US 11,198,588 B2
(45) Date of Patent: Dec. 14, 2021

(54) COUNTERWEIGHT SLACK BELT DETECTION SWITCH

(71) Applicant: thyssenkrupp Elevator Innovation and Operations GmbH, Essen (DE)

(72) Inventors: Justin Charles Morse, Memphis, TN (US); Jeffrey Duvall, Woodstock, GA (US); Jonathan Ashley Brothers, Cordova, TN (US)

(73) Assignee: TK Elevator Innovation and Operations GmbH, Duesseldorf (DE)

( * ) Notice: Subject to any disclaimer, the term of this patent is extended or adjusted under 35 U.S.C. 154(b) by 373 days.

(21) Appl. No.: 16/451,115

(22) Filed: Jun. 25, 2019

(65) Prior Publication Data

US 2020/0002129 A1 Jan. 2, 2020

Related U.S. Application Data

(60) Provisional application No. 62/690,687, filed on Jun. 27, 2018.

(51) Int. Cl.

| | |
|---|---|
| ***B66B 5/12*** | (2006.01) |
| ***B66B 7/10*** | (2006.01) |
| ***B66B 7/06*** | (2006.01) |

(52) U.S. Cl.

CPC ..... *B66B 5/12* (2013.01); *B66B 7/068* (2013.01); *B66B 7/10* (2013.01)

(58) Field of Classification Search

CPC ..... B66B 5/12; B66B 5/125; B66B 7/068; B66B 7/10

See application file for complete search history.

(56) References Cited

U.S. PATENT DOCUMENTS

| | | | | |
|---|---|---|---|---|
| 1,901,635 | A * | 3/1933 | Dunlop | B66B 5/12 187/411 |
| 2008/0185232 | A1* | 8/2008 | Henneau | B66B 5/00 187/277 |
| 2012/0024637 | A1* | 2/2012 | Henneau | B66B 5/125 187/394 |
| 2019/0084801 | A1* | 3/2019 | Blanchard | B66B 5/12 |
| 2020/0002129 | A1* | 1/2020 | Morse | B66B 5/125 |

FOREIGN PATENT DOCUMENTS

| | | | | |
|---|---|---|---|---|
| GB | 786410 | A * | 11/1957 | B66B 7/06 |

* cited by examiner

*Primary Examiner* — Michael A Riegelman

(74) *Attorney, Agent, or Firm* — William J. Cassin

(57) ABSTRACT

A counterweight slack detection switch including a body, a first belt guide mounted to the body and configured to engage a first side of a tension member, a second belt guide mounted to the body and configured to engage the first side of the tension member, a lever arm having a first end and a second end, the first end pivotally mounted to the body, a deflectable member biasing the lever arm relative to the body, a third belt guide mounted to the second end of the lever arm and configured to bias the tension member from a tension position to a slack position, and a switch mounted to the body and configured to contact the tension member when the tension member is in at least one of the tension position and the slack position.

11 Claims, 10 Drawing Sheets

COUNTERWEIGHT SLACK BELT DETECTION SWITCH

CROSS-REFERENCE TO RELATED APPLICATION

This application is a non-provisional application claiming priority to U.S. Provisional Patent Application No. 62/690,687, which was filed Jun. 27, 2018, the entire contents of which are hereby incorporated by reference herein.

BACKGROUND OF THE INVENTION

Field of the Invention

The present disclosure is generally directed to a slack detection device for use in elevator systems. More particularly, the present disclosure is directed to a counterweight slack detection switch for detecting slack in a tension member connected to a counterweight.

Description of Related Art

Elevators for vertically transporting people and goods are an integral part of modern residential and commercial buildings. A typical elevator system includes an elevator car raised and lowered by a hoist system. The hoist system typically includes one or more tension members connecting the elevator car to a counterweight. The tension members are routed over drive and idler sheaves. The elevator car is raised or lowered due to frictional traction between the tension members and the rotating drive sheaves. A variety of tension member types, including wire rope, V-belts, flat belts, and chains, may be used, with the sheave assemblies having corresponding running surfaces to transmit tractive force between the tension members and the sheave assemblies.

If for any reason the counterweight becomes immovable during operation of the elevator, slack may propagate in the one or more tension members as the drive sheaves continue to rotate against the tension members. Depending on the coefficient of friction of the tension members, propagation of slack eventually causes the tension members to slip on the drive sheaves such that the elevator car ceases to move any further. Many elevator regulatory codes require that the tension members have a sufficiently low coefficient of friction so that only a small amount of slack is permitted to propagate in the tension members before the tension members begin to slip on the drive sheaves. Limiting the amount of slack in the tension members prevents excessive, even catastrophic, slippage of the elevator car once the slack overcomes the frictional traction of the tension members against the drive sheaves. Thus, limiting the coefficient of friction of the tension members partially self-regulates the elevator against unacceptable levels of car slippage.

Some modern types of tension members, such as composite belts, have inherently high coefficients of friction that permit unsafe levels of slack to propagate in the tension members. In order for such tension members to be safely utilized, alternative means of preventing slack propagation in the tension members is needed.

SUMMARY OF THE INVENTION

In view of the foregoing, there exists a need for devices for stopping operation of an elevator system to prevent unsafe levels of slack from propagating in tension members due to, for example, the counterweight not moving.

Embodiments of the present disclosure are directed to a counterweight slack detection switch including a body, a first belt guide mounted to the body and configured to engage a first side of a tension member, a second belt guide mounted to the body and configured to engage the first side of the tension member, a lever arm having a first end and a second end, the first end pivotally mounted to the body, a deflectable member biasing the lever arm relative to the body, a third belt guide mounted to the second end of the lever arm and configured to bias the tension member from a tension position to a slack position, and a switch mounted to the body and configured to contact the tension member when the tension member is in at least one of the tension position and the slack position.

In some embodiments, the third belt guide is configured to engage the first side of the tension member.

In some embodiments, the third belt guide is configured to engage a second side of the tension member opposite the first side of the tension member.

In some embodiments, counterweight slack detection switch further includes a clamp for securing the counterweight slack detection switch to the tension member.

In some embodiments, at least one of the first belt guide and the second belt guide includes a clamp for securing the counterweight slack detection switch to the tension member.

In some embodiments, the switch includes one of a momentary switch and a latching switch.

In some embodiments, the deflectable member includes one of a torsion spring, a compression spring, a leaf spring, and a tension spring.

In some embodiments, the lever arm includes a tab for engaging a portion of the deflectable member.

Other embodiments of the present disclosure are directed to an elevator system including an end termination, a tension member extending from the end termination, the tension member having a first side and second side opposite the first side, and a counterweight slack detection switch. The counterweight slack detection switch includes a body, a first belt guide mounted to the body and configured to engage the first side of the tension member, a second belt guide mounted to the body and configured to engage the first side of the tension member, a lever arm having a first end and a second end, the first end pivotally mounted to the body, a deflectable member biasing the lever arm relative to the body, a third belt guide mounted to the second end of the lever and configured to bias the tension member from a tension position to a slack position, and a switch mounted to the body and configured to contact the tension member when the tension member is in at least one of the tension position and the slack position.

In some embodiments, the third belt guide of the counterweight slack detection switch is configured to engage the first side of the tension member.

In some embodiments, the third belt guide of the counterweight slack detection switch is configured to engage the second side of the tension member opposite the first side of the tension member.

These and other features and characteristics of a counterweight slack detection switch, as well as elevator systems including the same, will become more apparent upon consideration of the following description and the appended claims with reference to the accompanying drawings, all of which form a part of this specification, wherein like reference numerals designate corresponding parts in the various figures. It is to be expressly understood, however, that the drawings are for the purpose of illustration and description only and are not intended as a definition of the limits of the disclosure. As used in the specification and claims, the singular forms of "a", "an", and "the" include plural referents unless the context clearly dictates otherwise.

DETAILED DESCRIPTION OF THE INVENTION

Figure 1:
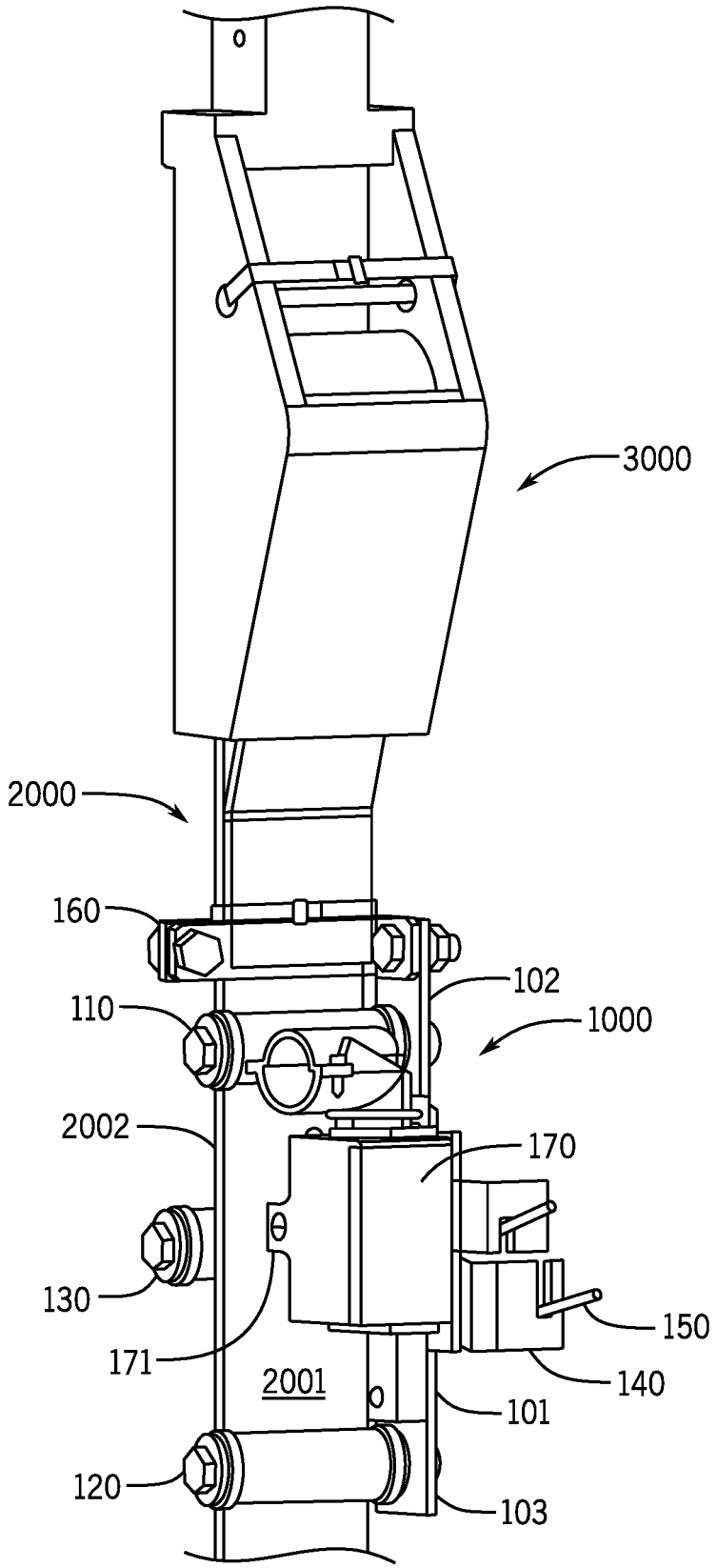
FIG. 1 is a front perspective view of a counterweight slack detection switch according to an embodiment of the present disclosure arranged on a tension member.

For purposes of the description hereinafter, the terms "upper", "lower", "right", "left", "vertical", "horizontal", "top", "bottom", "lateral", "longitudinal", and derivatives thereof shall relate to the disclosed apparatus as it is oriented in the figures. However, it is to be understood that the apparatus of the present disclosure may assume alternative variations and step sequences, except where expressly specified to the contrary. It is also to be understood that the specific systems and processes illustrated in the attached drawings and described in the following specification are simply exemplary examples of the apparatus disclosed herein. Hence, specific dimensions and other physical characteristics related to the examples disclosed herein are not to be considered as limiting.

As used herein, the terms "sheave" and "pulley" are used interchangeably to describe a wheel for tractive connection to a tension member of any type. It is to be understood that a "pulley" is encompassed by the recitation of a "sheave", and vice versa, unless explicitly stated to the contrary.

As used herein, the terms "substantially" or "approximately", when used to relate a first numerical value or condition to a second numerical value or condition, means that the first numerical value or condition is within 10 units or within 10% of the second numerical value or condition, as the context dictates and unless explicitly indicated to the contrary. For example, the term "substantially parallel to" means within plus or minus 10° of parallel. Similarly, the term "substantially perpendicular to" means within plus or minus 10° of perpendicular. Similarly, the term "substantially equal in volume" means within 10% of being equal in volume. "Substantially the same" means within normal manufacturing tolerances.

As used herein, the terms "transverse", "transverse to", and "transversely to" a given direction mean not parallel to that given direction. Thus, the terms "transverse", "transverse to", and "transversely to" a given direction encompass directions perpendicular to, substantially perpendicular to, and otherwise not parallel to the given direction.

As used herein, the term "diameter" means any straight line segment passing through a center point of a circle, sphere, ellipse, ellipsoid, or other rounded two- or three-dimensional object from one point on the periphery of said object to another point on the periphery of said object. Non-circular and non-spherical objects may have several such diameters of differing length, including a major diameter being the longest straight line segment meeting the aforementioned criteria, and a minor diameter being the shortest straight line segment meeting the aforementioned criteria.

As used herein, the term "associated with", when used in reference to multiple features or structures, means that the multiple features or structures are in contact with, touching, directly connected to, indirectly connected to, adhered to, or integrally formed with one another.

As used herein, the term "configured" or "configuration" refers to structural size and/or shape.

Referring to the drawings in which like reference numerals refer to like parts throughout the several views thereof, the present disclosure is generally directed to a counterweight slack detection switch for use on a tension member of an elevator system. It is to be understood, however, that the slack detection switch described herein may be used in many different applications in which tension members are utilized in traction with sheaves. The present disclosure is also directed to an elevator system utilizing the counterweight slack detection switch.

Referring now to FIG. 1, a counterweight slack detection switch 1000 according to embodiments of the present disclosure is shown secured to a tension member 2000 of an elevator system. An upper end of the tension member 2000 is secured to an end termination 3000, and the tension member 2000 extends downwardly from the end termination 3000 toward a counterweight (not shown). While the tension member 2000 is shown as a flat belt, other forms of the tension member 2000, such as a v-belt, round belt, cable, or wire rope, may be used. The counterweight slack detection switch 1000 includes a body 101 having a first end 102 and a second end 103. A first belt guide 110 is mounted to the first end 102 of the body 101, and a second belt guide 120 is mounted to the second end 103 of the body 101. The first belt guide 110 and the second belt guide 120 are configured to engage a first side 2001 of a tension member 2000. A third belt guide 130 is mounted to a lever arm 140 pivotally connected to the body 101 between the first belt guide 110 and the second belt guide 120. The third belt guide 130 is configured to engage a second side 2002 of the tension member 2000. The first belt guide 110, second belt guide 120, and the third belt guide 130 rotationally and laterally constrain the slack detection switch 1000 about the tension member 2000. A clamp 160 may be mounted to the body 101 to vertically constrain the counterweight slack detection switch 1000 to the tension member 2000. A switch 170 is mounted to the body 101 such that a contact 171 of the switch 170 is directed toward the tension member 2000. The contact 171 of the switch 170 may be actuated by contact with the tension member 2000, the third belt guide 130, and/or the lever arm 140.

Figure 2:
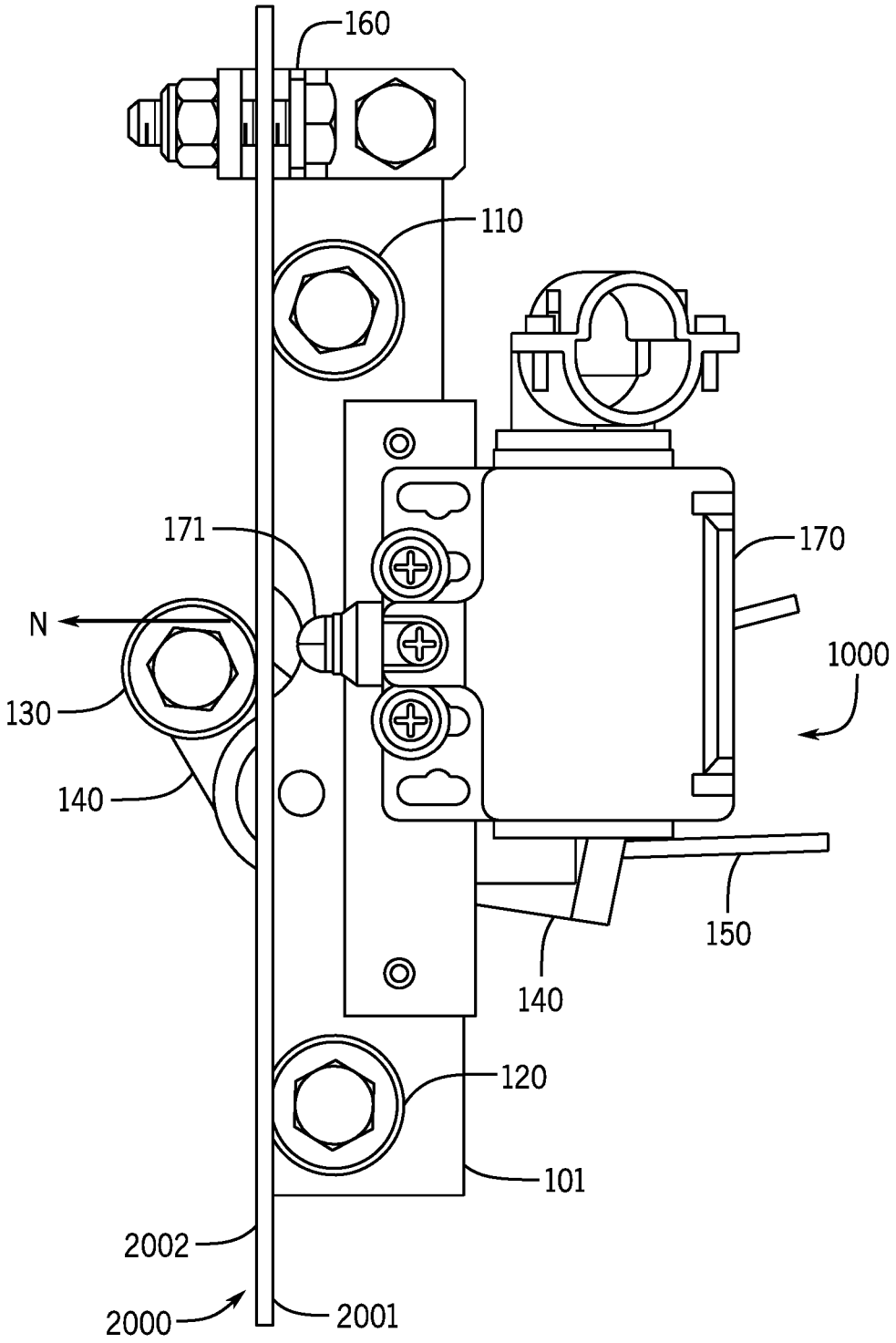
FIG. 2 is a left side view of the counterweight slack detection switch of FIG. 1, with the tension member in a tensioned state.

A deflectable member 150 biases the lever arm 140 such that the third belt guide 130 is drawn toward a plane tangent to the first belt guide 110 and the second belt guide 120. The deflectable member 150 is configured such that the force applied to the tension member 2000 by the third belt guide 130 causes deflection of the tension member 2000 when the tension member 2000 is in a state of reduced tension. FIG. 2 shows the slack detection switch 1000 engaged to the tension member 2000 in a slack position, i.e. with the tension member 2000 under a normal operating load, such as when the tension member 2000 is suspending the counterweight (not shown). Tension in the tension member 2000 creates a normal force N that counteracts the force exerted by the third belt guide 130 against the tension member 2000 due to the biasing effect of the deflectable member 150 against the lever arm 140. As such, deflection of the tension member 2000 between the first belt guide 110 and the second belt guide 120 is negligible. Even if deflection of the tension member 2000 does occur as a result of the force exerted by the third belt guide 130, the degree of deflection is insufficient to actuate the contact 171 of the switch 170.

Figure 3:
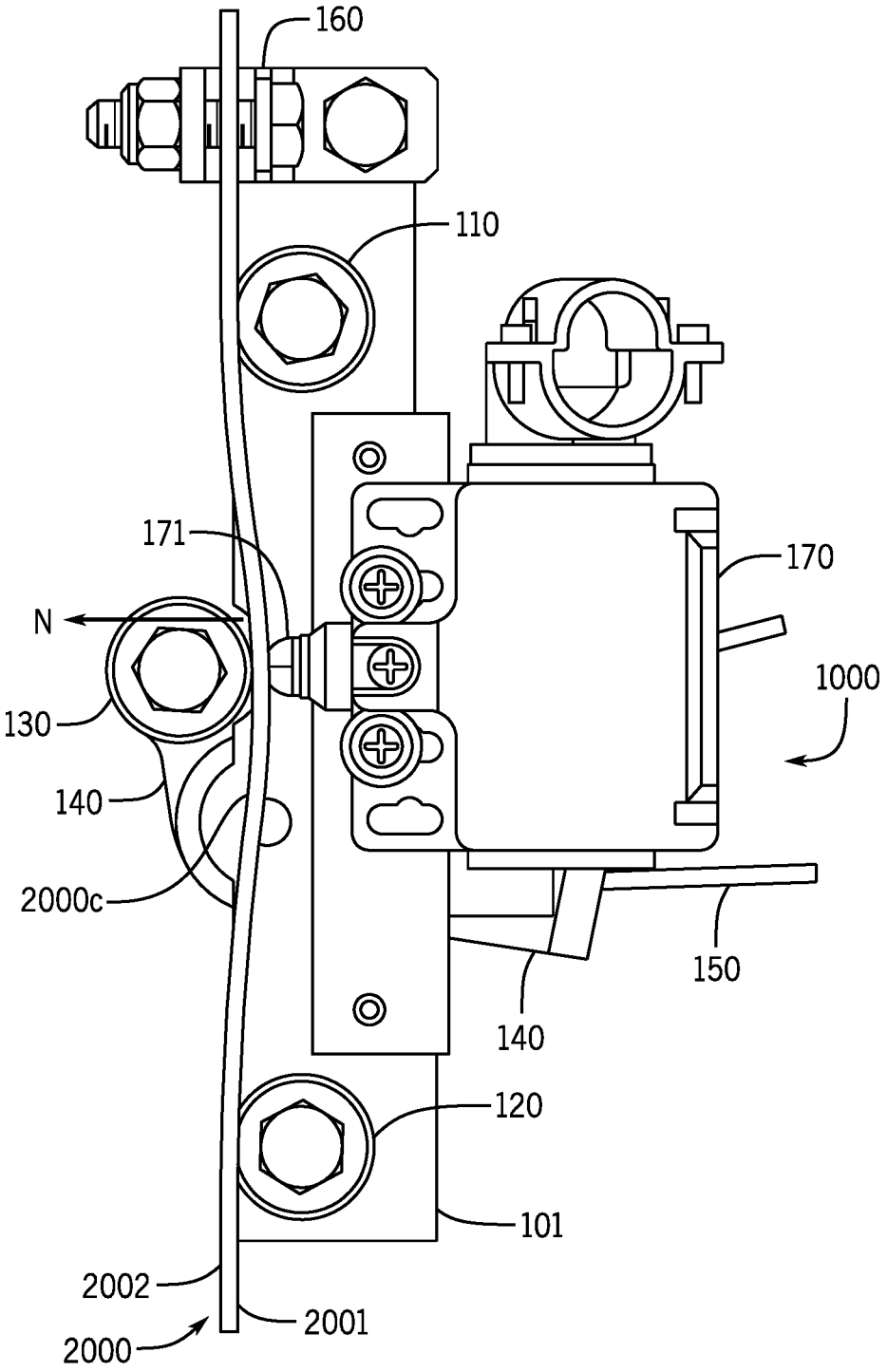
FIG. 3 is a left side view of the counterweight slack detection switch of FIG. 1, with the tension member in a reduced tension state.
Figure 4:
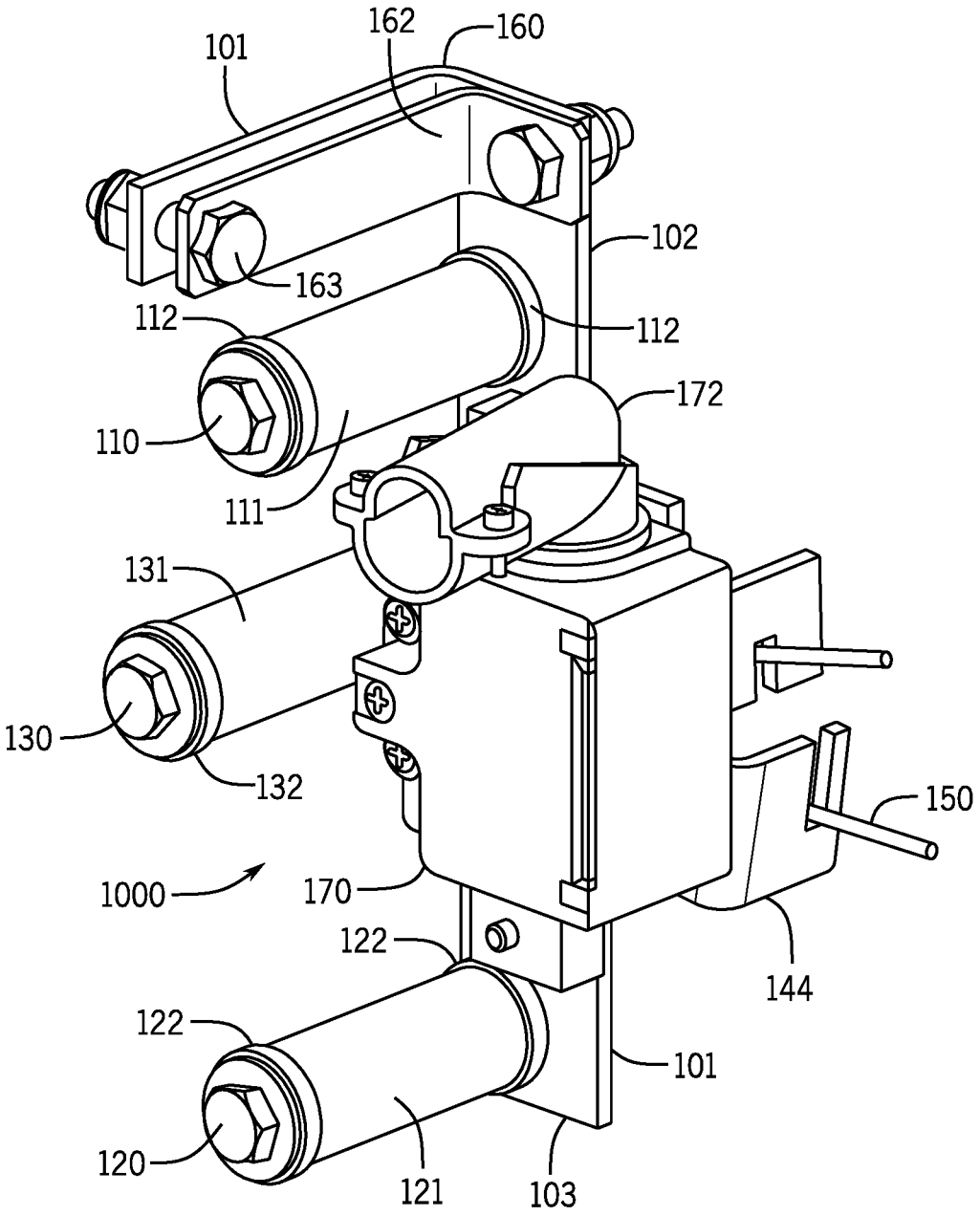
FIG. 4 is a left side perspective view of the counterweight slack detection switch of FIG. 1.
Figure 5:
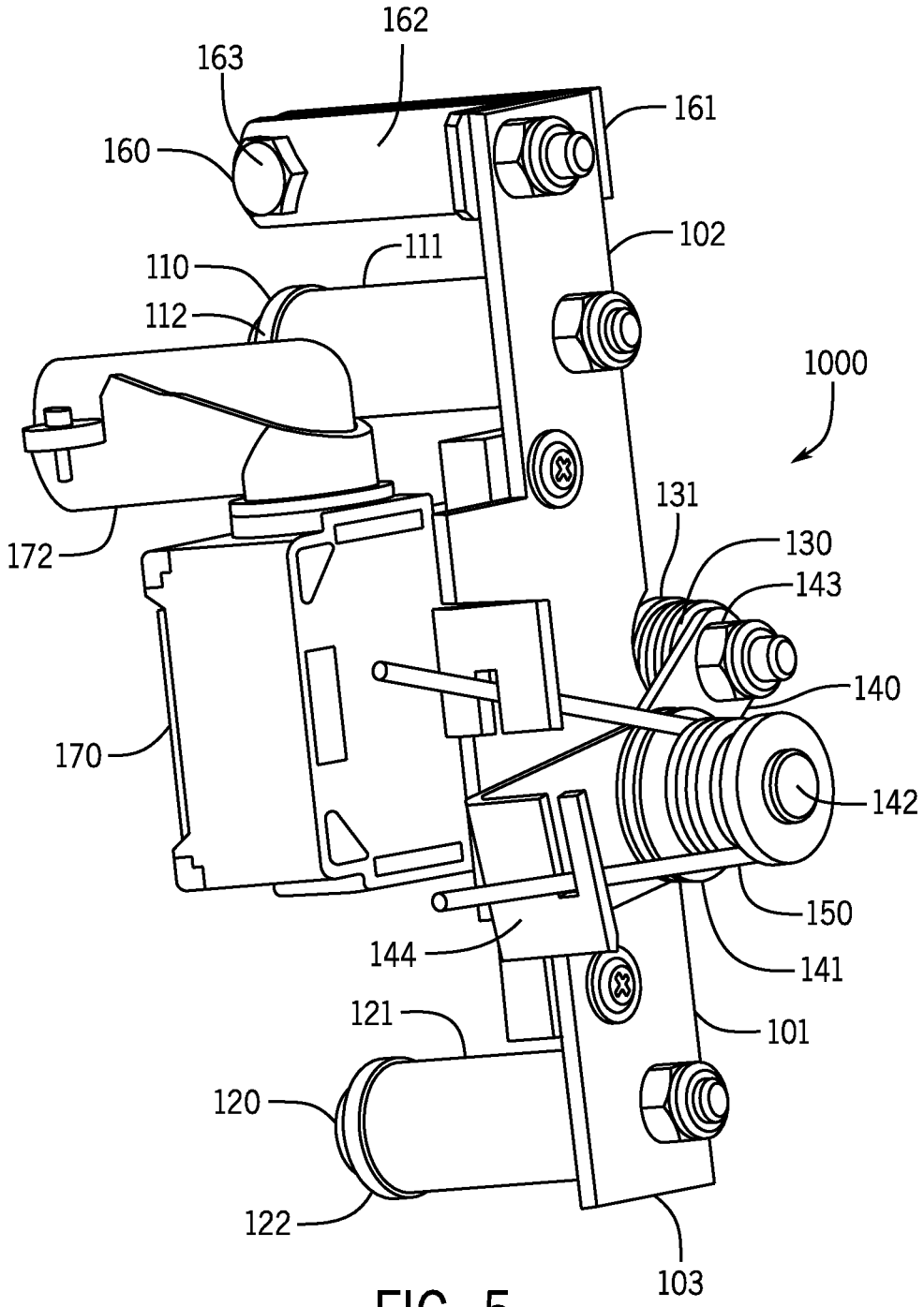
FIG. 5 is a right side perspective view of the counterweight slack detection switch of FIG. 1.
Figure 6:
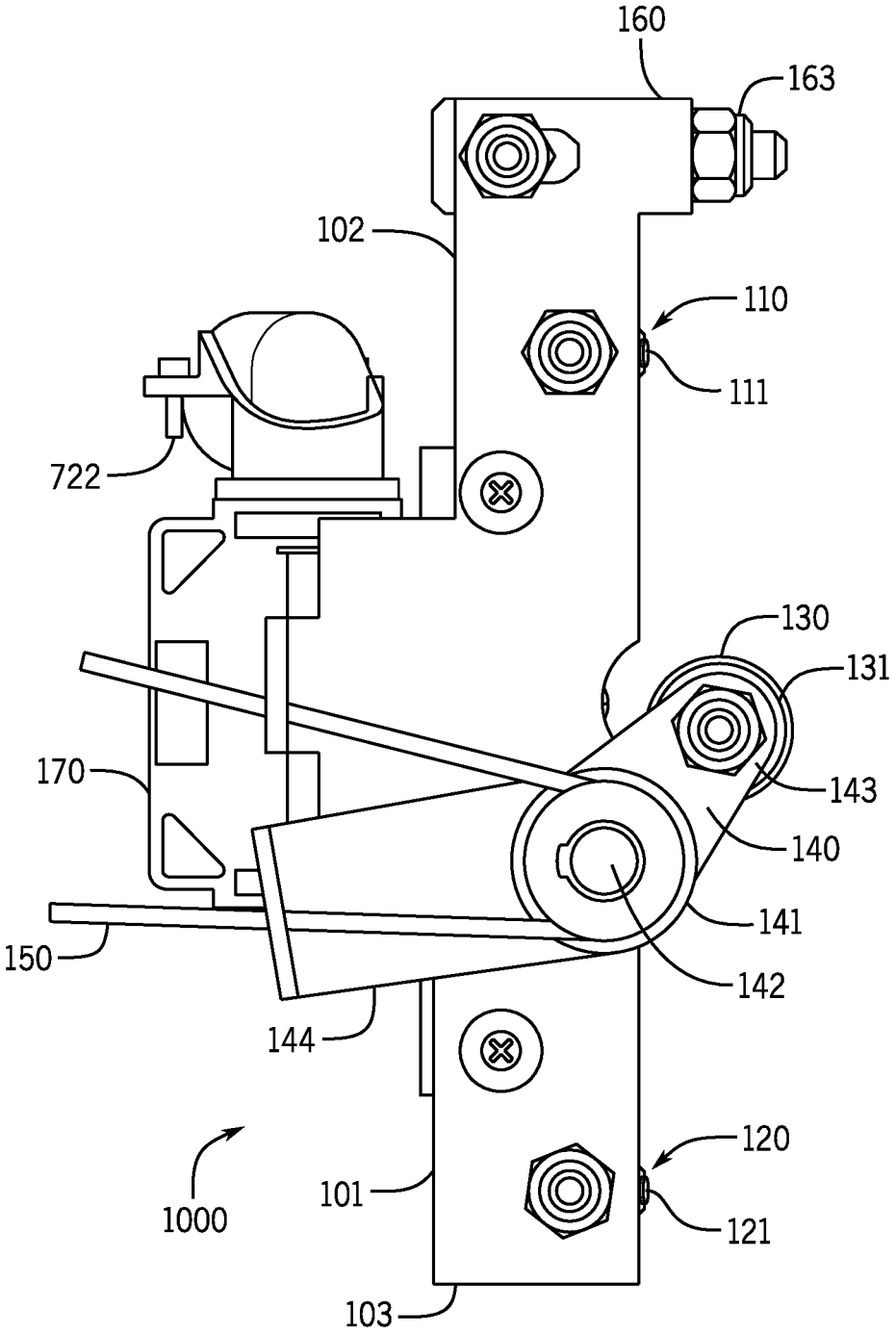
FIG. 6 is a right side view of the counterweight slack detection switch of FIG. 1.
Figure 7:
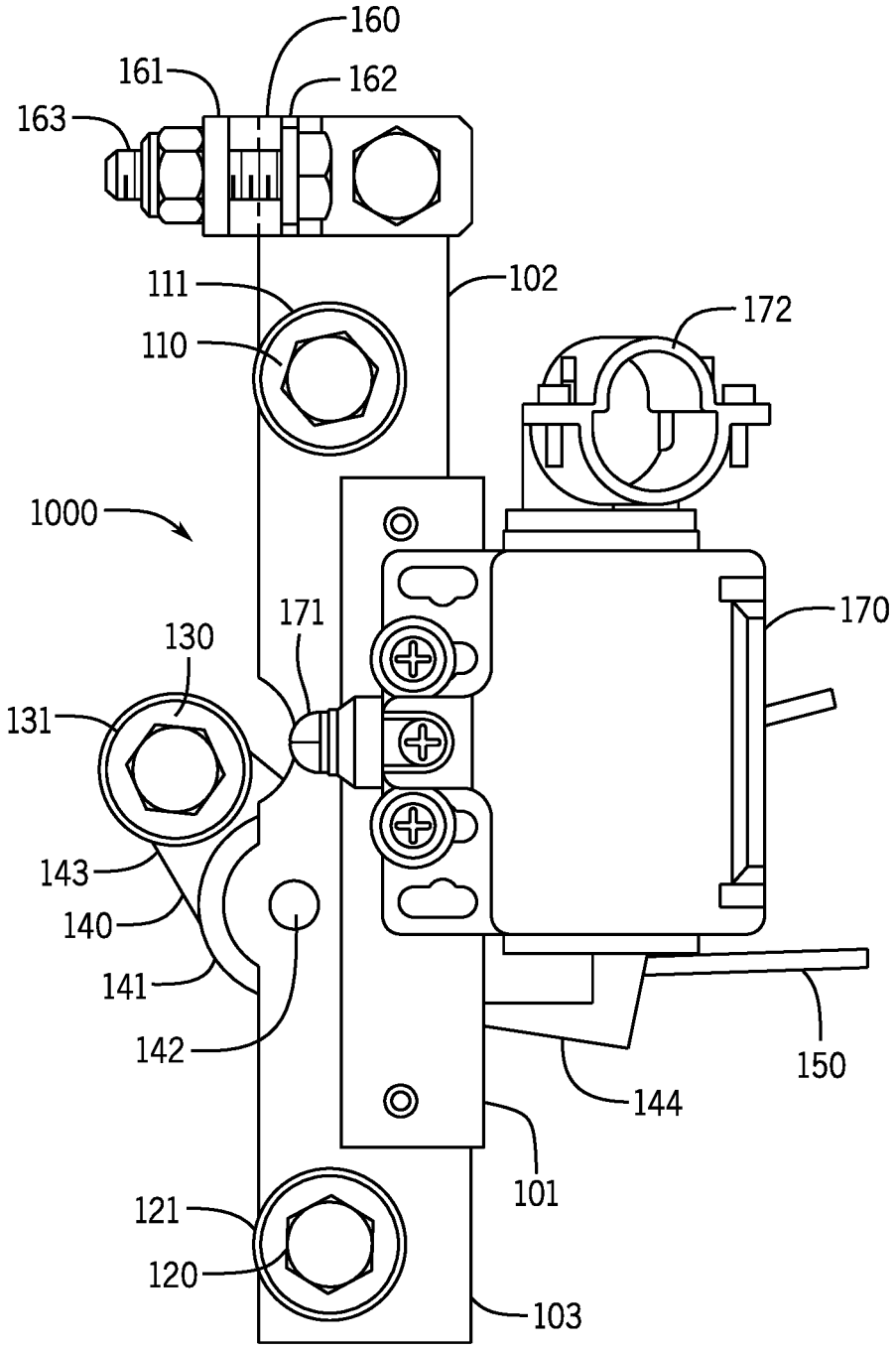
FIG. 7 is a left side view of the counterweight slack detection switch of FIG. 1.

FIG. 3 shows the slack detection switch 1000 engaged to the tension member 2000 in a slack position, i.e. with the tension member 2000 under a reduced operating load, such as when the counterweight fails to move and continued operation of the elevator allows slack to propagate in the tension member 2000. The normal force N is reduced as a result of the reduced tension, allowing the third belt guide 130 to deflect a central portion 2000*c* of the tension member 2000 between the first belt guide 110 and the second belt guide 120 due to the biasing effect of the deflectable member 150. Deflection of the tension member 2000 allows the tension member 2000, the third belt guide 130, and/or the lever arm 140 to contact and actuate the contact 171 of the switch 170.

The components of the slack detection switch 1000 shown in FIGS. 1-3 will now be described in greater detail with reference to FIGS. 4-7. The body 101 may be a rigid, longitudinally extending member having mounting locations for each of the first, second, and third belt guides 110, 120, 130, the lever arm 140, the deflectable member 150, the clamp 160, and the switch 170.

Each of the first, second, and third belt guides 110, 120, 130 may include a roller 111, 121, 131 which is freely rotatable to facilitate vertical positioning of the slack detection switch 1000 along the tension member 2000, and to prevent frictional shearing between the tension member 2000 and the first, second, and/or third belt guides 110, 120, 130 during deflection of the third belt guide 130. Each roller 111, 121, 131 may include a lip 112, 122, 132 on one or both ends to prevent lateral movement of the tension member 2000 relative to the slack detection switch 1000. In embodiments in which the tension member 2000 is a v-belt, cable, or wire rope, each of the rollers 111, 121, 131 may include a groove corresponding to the profile of the tension member 2000. In other embodiments, each of the first, second, and third belt guides 110, 120, 130 may be fixed, i.e., not rotatable relative to the body 101.

The lever arm 140 has a first end 141 pivotally attached to the body 101 via a pin 142 or other suitable fastening member. A second end 143 of the lever arm 140 provides a mounting location for the third belt guide 130. The lever arm 140 may include a tab 144 for engaging a portion of the deflectable member 150.

The deflectable member 150 may be a torsion spring, as shown in the drawings, or may be a tension spring, a compression spring, a leaf spring, an elastomer, a bladder, a hydraulic cylinder, a pneumatic cylinder, and/or a shock absorber. The deflectable member 150, when mounted to the body 101 and the lever arm 140, produces a force sufficient to bias the lever arm 140 when the tension member 2000 is in a state of reduced tension, such as when the counterweight is not moving as intended.

The clamp 160 may include a fixed portion 161 attached to or integral with the body 101, a moveable portion 162, and a fastener 163 for securing the moveable portion 162 to the fixed portion 161 with the tension member 2000 arranged between the moveable portion 162 and the fixed portion 161. Surfaces of the fixed portion 161 and/or the moveable portion 162 which engage the tension member 2000 may include surface features or a coating to prevent slipping of the tension member 2000 relative to the clamp 160.

The switch 170 includes a terminal connector 172 for communicating with a controller (not shown) of the elevator system. The switch 170 may be a momentary switch or a latching switch. The switch 170 may be either normally open or normally closed, depending on the programming of the controller. In the embodiment shown in the accompanying drawings, the switch 170 is arranged to engage the first side 2001 of the tension member 2000, such that deflection of the lever arm 140 biases the tension member 2000 toward the switch 170. If the contact 171 of the switch 170 is depressed due to deflection of the lever arm 140, the switch 170 communicates a fault state to the drive controller. In other embodiments, the switch 170 may be arranged to engage the second side 2002 of the tension member 2000 such that deflection of the lever arm 140 biases the tension member 2000 away from the switch 170. In such embodiments, the tension member 2000 depresses the contact 171 of the switch 170 when the tension member 2000 is under a normal load, i.e., when the counterweight is moving as intended. If the tension member 2000 releases from the contact 171 of the switch 170 due to deflection of the lever arm 140, the switch 170 communicates a fault state to the drive controller.

Figure 8:
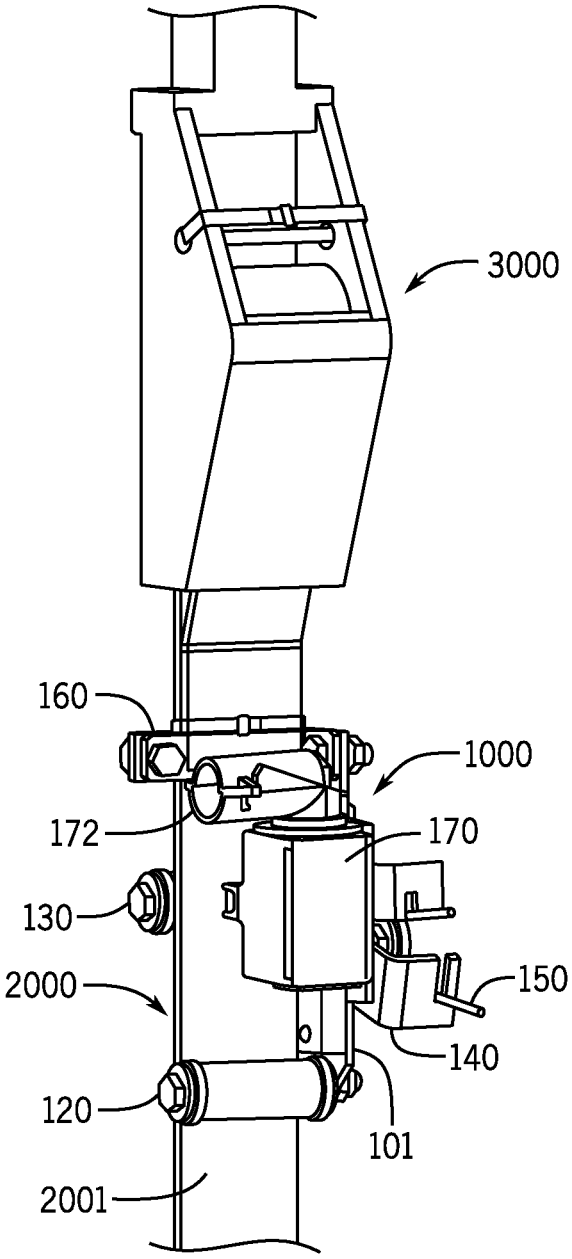
FIG. 8 is a front perspective view of a counterweight slack detection switch according to another embodiment of the present disclosure.
Figure 9:
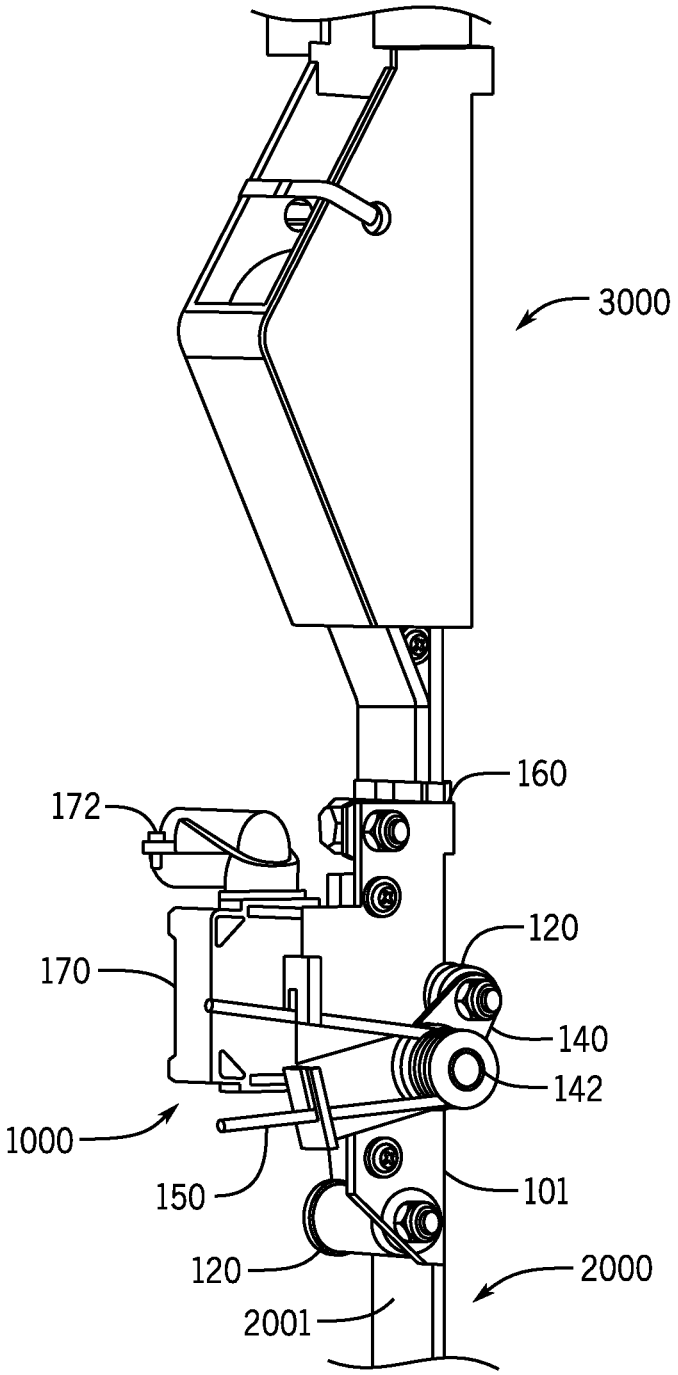
FIG. 9 is a right side perspective view of the counterweight slack detection switch of FIG. 8.
Figure 10:
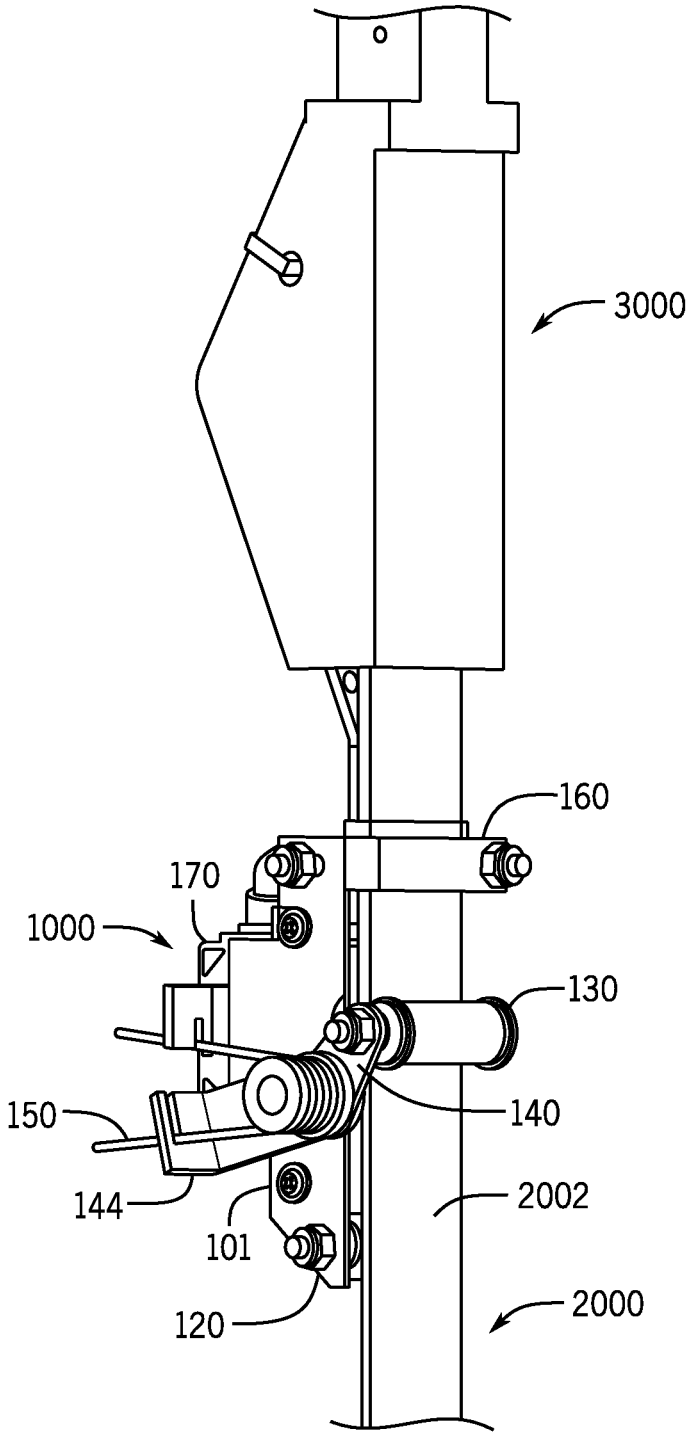
FIG. 10 is a rear perspective view of the counterweight slack detection switch of FIG. 8.

Referring now to FIGS. 8-10, in some embodiments of the slack detection switch 1000, the first belt guide 110 may include and/or be replaced with the clamp 160. The clamp 160 may be utilized, along with the second belt guide 120, to rotationally and laterally constrain the slack detection switch 1000 about the tension member 2000. The remaining components of the slack detection switch 1000 are essentially unchanged from the embodiment of FIGS. 1-7. In other embodiments, each of the first belt guide 110 and the second belt guide 120 may include and/or be replaced with a clamp.

The controller (not shown) of the elevator system is configured to operate the elevator car and counterweight based at least partially on input received from the switch 170. In particular, the slack detection switch 1000 communicates to the controller whether the tension member 2000 is in the tension position or the slack position. Under normal operation of the elevator system, the tension member 2000 is in the tension position, as shown and described with reference to FIG. 2. The tension member 2000, when in the tension position, is under sufficient tension from the weight of the counterweight to remain substantially undeflected by the bias of the third belt guide 130. In the embodiments shown in the accompanying drawings, the tension member 2000 does not depress the contact 171 of the switch 170 when in the tension position. Thus, non-depression of the contact 171 of the switch 170 communicates to the controller that the tension member 2000 is in the tension position. In other, not shown embodiments, the switch 170 may be arranged relative to the tension member 2000 such that the contact 171 is depressed with the tension member 2000 in the tension position, such that depression of the contact 171 communicates to the controller that the tension member 2000 is in the tension position. Regardless of the arrangement of the switch 170 relative to the tension member 2000, communication to the controller that the tension member 2000 is in the tension position indicates that the elevator system is operating correctly, and the controller performs no remedial action.

In contrast, if the slack detection switch 1000 detects that the tension member 2000 is in the slack position, as shown and described with reference to FIG. 3, the controller may perform a remedial action, such as stopping movement of the elevator car. The slack position arises when, for example, the counterweight becomes stuck such that the counterweight does not apply sufficient tension to the tension member 2000 to overcome the bias of the third belt guide 130. This allows the central portion 2000*c* of the tension member 2000 to deflect between the first belt guide 110 and the second belt guide 120. In the embodiments shown in the accompanying drawings, such deflection causes the tension member 2000, the third belt guide 130, and/or the lever arm 140 to depress the contact 171 of the switch 170, thereby communicating to the controller that the tension member 2000 is in the slack position. In other, not shown embodiments, the switch 170 may be arranged relative to the tension member 2000 such that the contact 171 is released with the tension member 2000 in the slack position, such that release of the contact 171 communicates to the controller that the tension member 2000 is in the slack position. Regardless of the arrangement of the switch 170 relative to the tension member 2000, communication to the controller that the tension member 2000 is in the slack position indicates that the elevator system is operating incorrectly, and the controller may perform a remedial action, such as stopping movement of the elevator car.

While several examples of a counterweight slack detection switch are shown in the accompanying figures and described in detail hereinabove, other examples will be apparent to and readily made by those skilled in the art without departing from the scope and spirit of the present disclosure. For example, it is to be understood that aspects of the various embodiments described hereinabove may be combined with aspects of other embodiments while still falling within the scope of the present disclosure. Accordingly, the foregoing description is intended to be illustrative rather than restrictive. The devices of the present disclosure described hereinabove are defined by the appended claims, and all changes to the disclosed devices that fall within the meaning and range of equivalency of the claims are to be embraced within their scope.

What is claimed is:

1. A counterweight slack detection switch, comprising:

a body;

a first belt guide mounted to the body and configured to engage a first side of a tension member;

a second belt guide mounted to the body and configured to engage the first side of the tension member;

a lever arm having a first end and a second end, the first end pivotally mounted to the body;

a deflectable member biasing the lever arm relative to the body;

a third belt guide mounted to the second end of the lever arm and configured to bias the tension member from a tension position to a slack position; and a switch mounted to the body and configured to contact the tension member when the tension member is in at least one of the tension position and the slack position.

2. The counterweight slack detection switch of claim 1, wherein the third belt guide is configured to engage the first side of the tension member.

3. The counterweight slack detection switch of claim 1, wherein the third belt guide is configured to engage a second side of the tension member opposite the first side of the tension member.

4. The counterweight slack detection switch of claim 1, further comprising a clamp for securing the counterweight slack detection switch to the tension member.

5. The counterweigh slack detection switch of claim 1, wherein at least one of the first belt guide and the second belt guide comprises a clamp for securing the counterweight slack detection switch to the tension member.

6. The counterweight slack detection switch of claim 1, wherein the switch comprises one of a momentary switch and a latching switch.

7. The counterweight slack detection switch of claim 1, wherein the deflectable member comprises one of a torsion spring, a compression spring, a leaf spring, and a tension spring.

8. The counterweight slack detection switch of claim 1, wherein the lever arm comprises a tab for engaging a portion of the deflectable member.

9. An elevator system comprising:

an end termination;

a tension member extending from the end termination, the tension member having a first side and second side opposite the first side; and a counterweight slack detection switch, comprising:

a body;

a first belt guide mounted to the body and configured to engage the first side of the tension member;

a second belt guide mounted to the body and configured to engage the first side of the tension member;

a lever arm having a first end and a second end, the first end pivotally mounted to the body;

a deflectable member biasing the lever arm relative to the body;

a third belt guide mounted to the second end of the lever arm and configured to bias the tension member from a tension position to a slack position; and a switch mounted to the body and configured to contact the tension member when the tension member is in at least one of the tension position and the slack position.

10. The elevator system of claim 9, wherein the third belt guide of the counterweight slack detection switch is configured to engage the first side of the tension member.

11. The elevator system of claim 9, wherein the third belt guide of the counterweight slack detection switch is configured to engage the second side of the tension member opposite the first side of the tension member.

* * * * *